US007318669B2

(12) United States Patent
Schneider

(10) Patent No.: US 7,318,669 B2
(45) Date of Patent: Jan. 15, 2008

(54) SPRING-BARREL ARRANGEMENT FOR A TIMEPIECE

(75) Inventor: Jens Schneider, Glashütte-Johnsbach (DE)

(73) Assignee: Lange Uhren GmbH, Glashuette (DE)

( * ) Notice: Subject to any disclaimer, the term of this patent is extended or adjusted under 35 U.S.C. 154(b) by 552 days.

(21) Appl. No.: 11/006,285

(22) Filed: Dec. 7, 2004

(65) Prior Publication Data

US 2005/0249045 A1 Nov. 10, 2005

(30) Foreign Application Priority Data

Dec. 8, 2003 (DE) ..... 103 57 228

(51) Int. Cl.
*G04B 1/10* (2006.01)

(52) U.S. Cl. ..... 368/140; 368/144

(58) Field of Classification Search ..... 368/140, 368/144

See application file for complete search history.

(56) References Cited

U.S. PATENT DOCUMENTS

| | | | | |
|---|---|---|---|---|
| 848,976 A | | 4/1907 | Currie | |
| 861,727 A | | 7/1907 | Hubscher | |
| 3,294,198 A | * | 12/1966 | Pfeffer | 185/37 |
| 3,852,954 A | * | 12/1974 | Bachmann | 368/140 |
| 3,974,639 A | | 8/1976 | Gilomen et al. | |
| 4,363,553 A | * | 12/1982 | Thomi et al. | 368/140 |
| 5,119,348 A | * | 6/1992 | Mathys | 368/151 |

FOREIGN PATENT DOCUMENTS

| | | |
|---|---|---|
| CH | 29070 | 9/1903 |
| CH | 29185 | 9/1903 |
| CH | 31786 | 2/1905 |
| CH | 319 631 | 2/1957 |
| CH | 521 623 | 12/1971 |
| CH | 3573 | 7/1981 |
| FR | 431 728 | 6/1911 |
| FR | 2 287 717 | 5/1974 |

* cited by examiner

*Primary Examiner*—P. Austin Bradley
*Assistant Examiner*—Jeanne-Marguerite Goodwin
(74) *Attorney, Agent, or Firm*—Cohen Pontani Lieberman & Pavane LLP

(57) ABSTRACT

A spring-barrel arrangement for a timepiece includes a fixed plate-like component with a circular cutout. A spring barrel is rotatably mounted in said circular cutout by its corresponding circular outer contour. A barrel core is coaxially rotatably mounted relative to the spring barrel and is enclosed by a helical tension spring. An inner end of the spring is connected to the barrel core and its outer end connected to the spring barrel. A crown wheel with a toothed ring is fixed to the spring barrel and a first wheel of a wheel train of the timepiece is fixed to the barrel core. The circular cutout is formed through the plate-like component and the spring barrel has two supporting regions which extend radially beyond the diameter of the circular cutout and are each in abutment against one of the mutually opposite side surfaces of the plate-like component.

34 Claims, 3 Drawing Sheets

SPRING-BARREL ARRANGEMENT FOR A TIMEPIECE

BACKGROUND OF THE INVENTION

1. Field of the Invention

The present invention relates to a spring-barrel arrangement for a timepiece, including a fixed plate-like component which has a circular cutout in which a spring barrel is rotatably mounted by its corresponding circular outer contour, a barrel core which is rotatable coaxially in relation to the spring barrel, a helical tension spring having an inner end connected to the barrel core and an outer end connected to the spring barrel, a crown wheel having a toothed ring being fixed to the spring barrel, and a first wheel of a wheel train of the timepiece being fixed to the barrel core.

2. Description of the Related Art

In a known spring-barrel arrangement, an annular spring barrel is mounted in a cup-shaped depression of a plate-like component. A crown wheel, which is fixed to the annular spring barrel, projects into a large step of the depression. An annular part is connected to the plate-like component on an open side of the depression for axially fixing the crown wheel on an open side of the depression.

Since the spring barrel is only mounted in the small step of the depression, the bearing length in relation to the diameter of the spring barrel is small, with the result that the spring barrel in the depression can tilt and jam to a considerable extent in deviation from its desired axis.

Mounting the barrel core independently of the spring barrel also results in the barrel core deviating to a considerable extent from the desired axis, which, via the first wheel of the wheel train which is connected to the barrel core, adversely affects the accuracy of the movement or clockwork mechanism.

SUMMARY OF THE INVENTION

An object of the present invention is to provide a spring-barrel arrangement for a timepiece which, along with high accuracy of the wheel train of the timepiece, is distinguished by requiring only a small amount of space and allows precise mounting of the barrel core as it runs down.

This object is achieved according to the present invention in that a circular cutout is formed right through the plate-like component and the spring barrel has two supporting regions which extend radially beyond the diameter of the circular cutout and are each in abutment against one of the mutually opposite side surfaces of the plate-like component. Alternatively, one supporting region abuts against a side surface of the plate-like component and the other supporting region abuts against a bridge which is parallel to the plate-like component.

According to the invention, a large part of the thickness of the plate-like component is used as bearing length. The increased bearing length, together with fact that the supporting regions abutt against the mutually opposite side surfaces of the plate-like component, allows a largely tilt-free mounting of the spring barrel along with a low level of play and a simultaneously low overall height to be achieved.

For a straightforward installation, at least one of the supporting regions may be connected in a releasable manner to the spring barrel, in particular by a screw connection.

A stable configuration with sufficiently large screws is made possible here in that the spring barrel is of cup-shaped design with a base, the at least one supporting region is connected to the base by screws.

The base and the supporting region connected to this base may have coaxial through-bores through which the barrel core projects out of the spring barrel.

For precise coaxial positioning and, in addition, form-fitting connection, the base may have a cylindrical centering extension which projects coaxially to the outside and on which a disc-like supporting region can be positioned by way of a corresponding bore.

In order that the axes of rotation of the barrel core and spring barrel correspond with a high level of accuracy, the base may have a coaxial bearing bore in which one end of the barrel core is mounted in a rotatable manner or into which is inserted a bearing for mounting one end of the barrel core in a rotatable manner. As a result, the accuracy of the movement or clockwork mechanism is also increased.

It is also possible, however, for one end of the barrel core to be mounted in a rotatable manner in a bearing which is arranged in a bridge which is parallel to the plate-like component.

If that end of the barrel core which projects out of the spring barrel bears a gearwheel of an additional device, this gives rise to a variety of possible arrangements not just for mountings of the barrel core, but also for the connection of additional functions.

The end of the barrel core which projects out of the spring barrel may bear a gearwheel of an additional device, in which case the gearwheel may be a gearwheel of a setting mechanism for limiting the number of revolutions or a gearwheel of a mechanism for indicating a power reserve.

The additional device may be arranged outside the spring barrel, on the top side of the supporting region designed as a crown wheel, and to be easily accessible, for example, for setting operations.

One end of the barrel core may be mounted in a rotatable manner in a bearing which is arranged on a fixed bottom plate, which is spaced apart from the plate-like component by a distance which allows a relatively large distance between the bearings of the barrel core. This facilitates precise mounting of the first wheel of the wheel train of the timepiece and thus also a high level of accuracy of the movement or clockwork mechanism.

Performing a double function, and thus reducing the amount of installation space, one of the supporting regions of the spring barrel may be designed as a crown wheel. The crown wheel here may also be a ratchet wheel.

In a design which requires only a small number of components, the spring barrel is provided with the toothed ring of the crown wheel.

At least one of the supporting regions of the spring barrel may be of annular design.

A construction which requires only a small number of components is likewise achieved if one of the supporting regions is formed integrally with the spring barrel.

If the plate-like component has a stepped recess which surrounds the circular cutout and in which is arranged one of the supporting regions, which is supported axially on the base of the stepped recess, then a low overall height is achieved.

If the base of the stepped recess has an axially projecting annular extension, on which the supporting region is supported, then the frictional resistances upon rotation of the first spring barrel, on account of the small surface area over which the one supporting region butts against the base of the stepped recess, are low.

The fixed plate-like component may, if performing a double function, be a wheel bridge.

The first wheel of the movement or clockwork mechanism is preferably a drive wheel.

To increase the running duration of the timepiece, along with requiring only a small amount of space for the spring-barrel arrangement, the spring barrel may include a further spring barrel arranged coaxially in relation to the above-mentioned spring barrel. In this embodiment, the barrel core projects through both spring barrels, the barrel core comprising a barrel stem and a barrel sleeve which is mounted in a rotatable manner on the barrel stem and to which the tension spring is connected by way of its inner end. In addition, a further helical tension spring encloses the barrel core and has its inner end connected to the barrel sleeve and its outer end connected to the further spring barrel. The first wheel of the movement or clockwork mechanism is fixed to the barrel stem and the further spring barrel.

In this case, accuracy-influencing friction only occurs to a small extent between the spring-connecting links.

Only a small number of components are necessary if the further spring barrel is of cup-shaped design with a base, to which the barrel stem is fixed.

Good coaxial positioning of the further spring barrel and barrel stem is achieved if the base has a coaxial opening through which the barrel stem projects.

The number of components which are to be installed is reduced further if the further spring barrel is formed integrally with the first wheel of the movement or clockwork mechanism.

To secure the tension springs in their spring barrels, at least one of the coaxial openings of the spring barrel and/or of the further spring barrel may be closed by a spring-barrel cover which has a coaxial opening through which the barrel core projects.

One or more bearings of the barrel core may be designed as jewel holes.

Straightforward installation is achieved if the helical tension spring and/or the further helical tension spring are/is connected with self-hooking action, by means of a spring rose, to the spring barrel and/or to the further spring barrel and/or to the barrel core.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1:
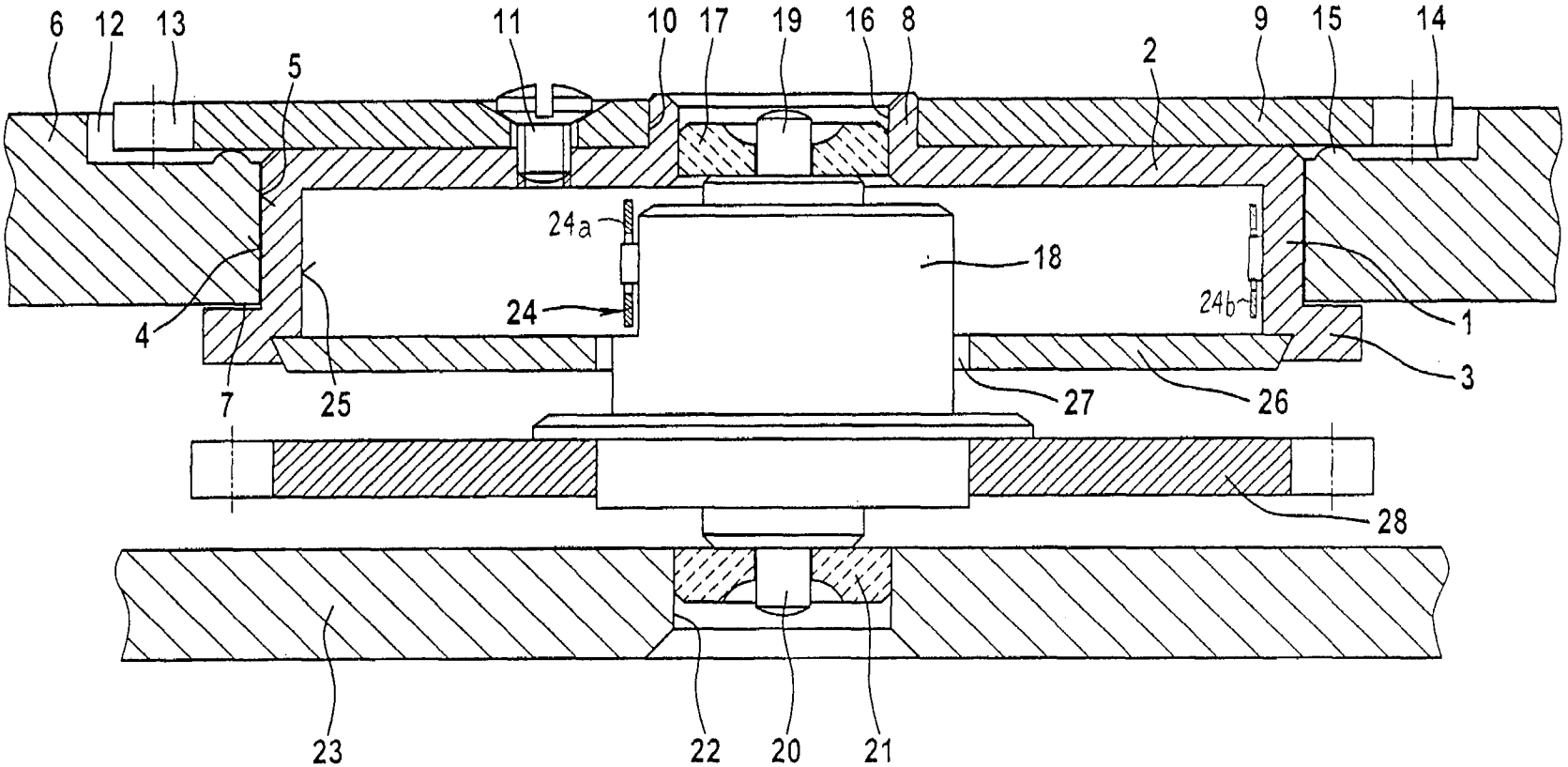
FIG. 1 is an axial cross-sectional view of a spring-barrel arrangement with a single spring barrel.
Figure 2:
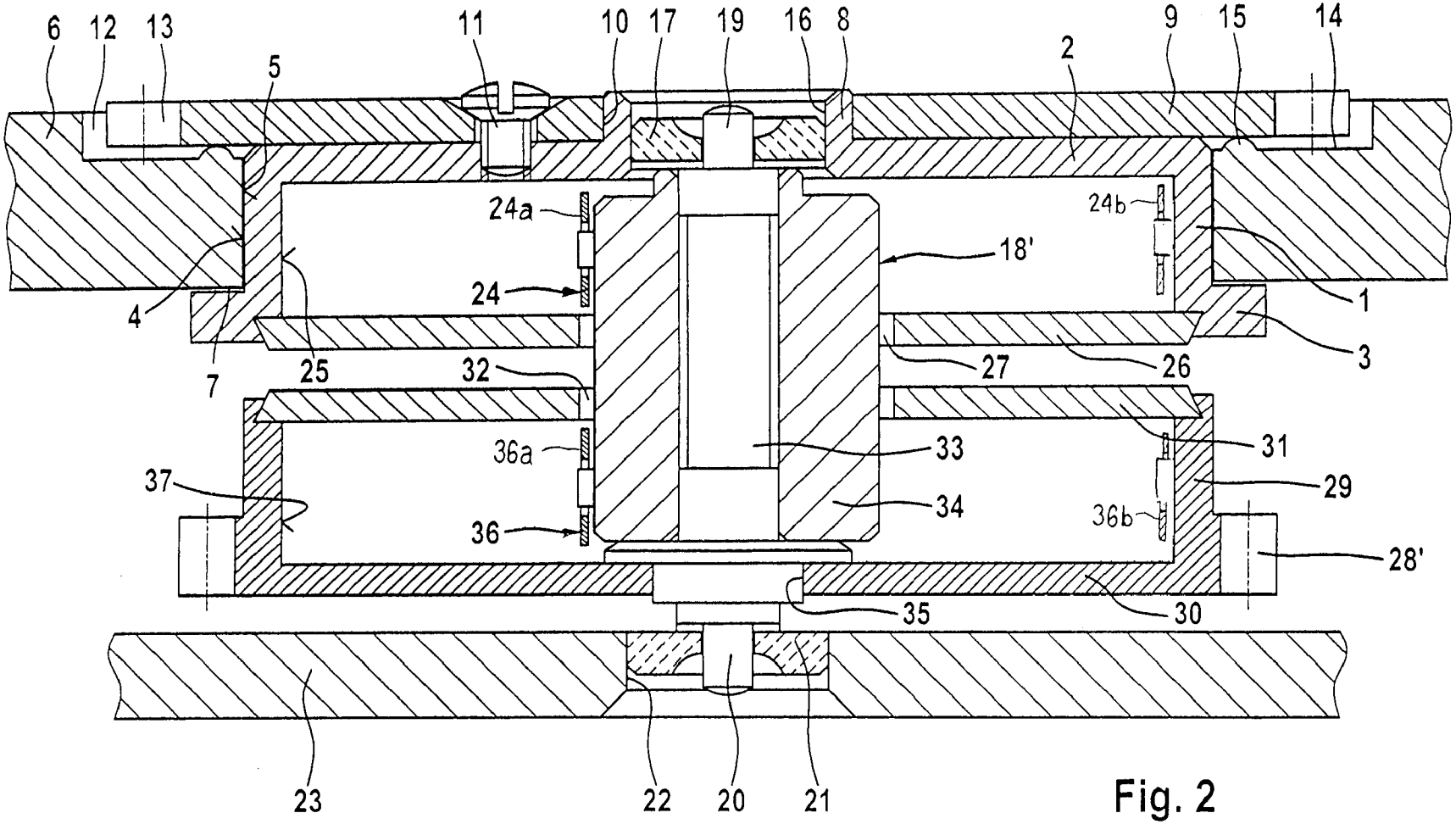
FIG. 2 is an axial cross-sectional view of a spring-barrel arrangement with a double spring barrel.

The spring-barrel arrangements illustrated in FIGS. 1 and 2 have a cup-shaped spring barrel 1 with a base 2. A first, annular supporting region 3 which widens in a flange-like manner is arranged at a cup opening of the cup-like spring barrel 1.

The spring barrel 1 has a cylindrical outer contour 4 which is inserted into a circular cutout 5 in a wheel bridge 6, until the supporting region 3 butts against one side surface 7 of the wheel bridge 6. The spring barrel is thus rotatably mounted in the wheel bridge 6.

The axial side of the base 2 of the spring barrel 1 opposing the cup opening has a cylindrical centering extension 8 which projects coaxially towards the outside. A disc-like crown wheel 9 has a central bore 10 corresponding to the centering extension 8 and is fixed to the spring barrel 1 by screws 11.

The crown wheel 9 extends radially beyond the external diameter of the spring barrel 1 into a stepped recess 12 of the cutout 5, which is designed as a stepped bore. The crown wheel 9 has a toothed ring 13 on its radially encircling circumference.

The toothed ring 13 may be designed as a ratchet wheel and engage a toothed wheel (not illustrated) of a winding device.

Provided on the base 14 of the step-like recess 12, concentrically in relation to the cutout 5, is an axially projecting annular extension 15 of the wheel bridge 6. The annular extension 15 has an approximately semicircular cross section and the crown wheel 9, which forms one supporting region of the spring barrel 1, butts axially against the annular extension 15.

Figure 1A:
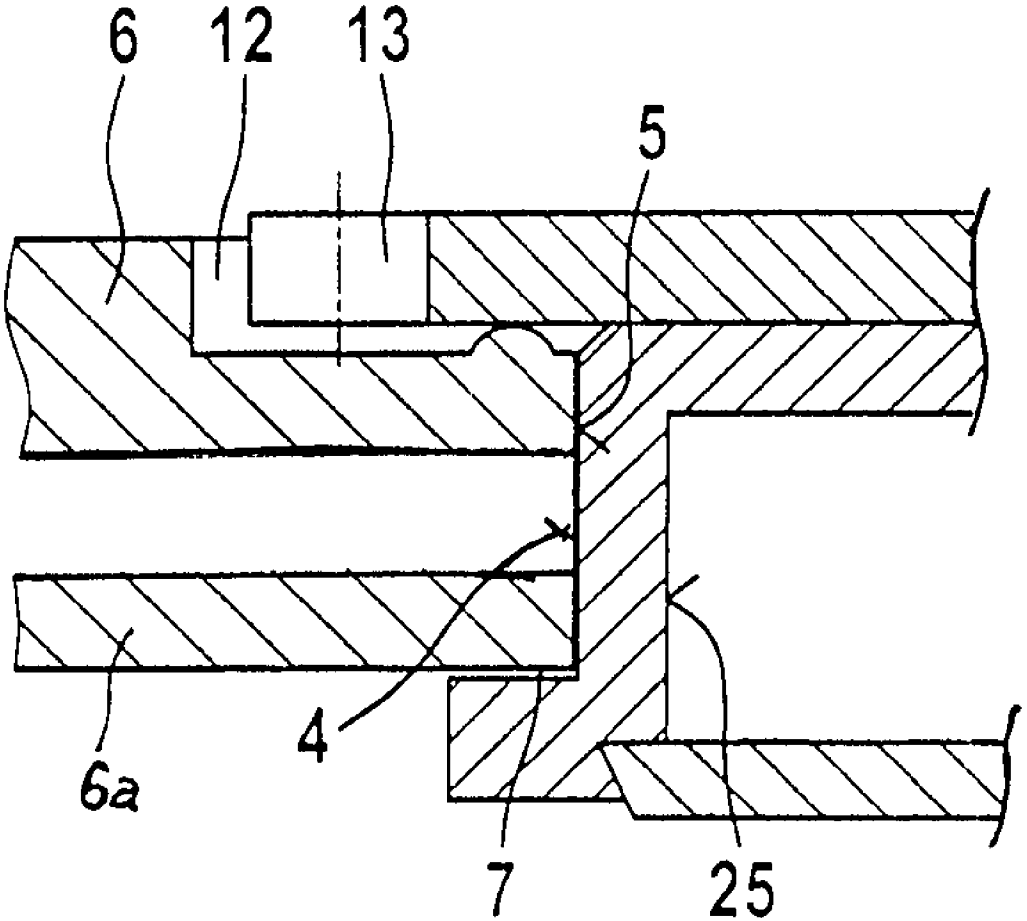
FIG. 1*a* is a cross-sectional view of a portion of the arrangement of FIG. 1 showing an alternate embodiment.

The spring barrel 1 thus butts against the mutually opposite side surfaces of the wheel bridge 6 by the crown wheel 9 and the supporting region 3. In an alternate embodiment shown in FIG. 1*a*, the crown wheel 9 butts against a side surface of the wheel bridge 6 and the supporting region butts against a side surface of a plate 6*a* that is parallel to the wheel bridge. The positions of the wheel bridge 6 and the plate 6*a* could be reversed.

Referring again to FIGS. 1 and 2, the base 2 of the spring barrel 1 has a bearing bore 16 which passes there-through coaxially. A bearing 17 is inserted in the bearing bore 16 for mounting the bearing journal 19 of one end of a barrel core 18, 18' in a rotatable manner. The barrel core 18, 18' projects coaxially through the cup opening of the spring barrel 1 and is mounted in a rotatable manner, by way of the bearing journal 20 at its other end, in a second bearing 21, which is inserted into a bearing bore 22 of a bottom plate 23 which is fixed parallel to, and at a distance from, the wheel bridge 6.

The spring barrel 1 contains a helical tension spring 24 which encloses the barrel core 18, 18'. For brevity and clarity, only the ends 24*a*, 24*b* of the tension spring 24 are shown. The inner end 24*a* of the tension spring 24 is connected to the barrel core 18, 18'. The outer end 24*b* of the tension spring 24 is connected to the radially encircling inner wall 25 of the spring barrel 1.

The opening of the cup-shaped spring barrel 1 is closed by a spring-barrel cover 26 which has a coaxial opening 27 through which the barrel core 18, 18' projects outwards from the interior of the spring barrel 1.

In FIG. 1, a drive wheel 28 is fixed, as the first wheel of the movement or clockwork mechanism of the timepiece, on that end region of the barrel core 18 which projects out of the spring barrel 1.

In FIG. 2, the barrel core 18' projects into the opening of a further cup-shaped spring barrel 29. A base 30 of the further spring barrel 29 faces away from the spring barrel 1. The opening of the further spring barrel 29 is closed by a spring-barrel cover 31. This spring-barrel cover 31, like the spring-barrel cover 26, has a coaxial opening 32 through which the barrel core 18' projects into the interior of the spring barrel 29.

The barrel core 18 is formed in one piece in FIG. 1, whereas the barrel core 18' in FIG. 2 comprises a barrel stem 33 and a barrel sleeve 34 which is mounted in a rotatable manner on the barrel stem 33.

The barrel stem 33 is mounted in a rotatable manner in the bearings 17 and 21 by way of its bearing journals 19 and 20, one end being guided through a central opening 35 in the base 30 of the spring barrel 29. The base 30 of the spring barrel 29 here is connected in a rotationally fixed manner to the barrel stem 33.

The spring barrel 29 also contains a helical tension spring 36 which encloses the barrel core 18' and of which only the inner ends and outer 36*a*, 36*b* are illustrated. The inner end, like the inner end of the tension spring 24, is connected to the barrel sleeve 34 of the barrel 18'.

The outer end 36*b* of the tension spring 36 is connected to the radially encircling inner wall 37 of the spring barrel 29.

On its radially encircling outer lateral surface, the further spring barrel 29 is provided integrally with a toothed ring which forms a drive wheel 28', which is the first wheel of the wheel train of the timepiece. By virtue of a rotary drive of the crown wheel 9, the spring barrel is rotated and the tension spring 24 is thus subjected to stressing.

The tension spring 24, in FIG. 1, drives the drive wheel 28 via the barrel core 18. In FIG. 2, in the case of a rotary drive of the crown wheel 9, the spring barrel 1 is likewise rotated and the tension spring 24 is subjected to stressing. This tension spring 24, as a result of its stressing, drives the barrel sleeve 34 in rotation, as a result of which the tension spring 36, which is arranged in series with the tension spring 24, is also subjected to stressing, the tension spring 36 driving the spring barrel 29 and, with it, the drive wheel 28.

Connecting the tension springs 24 and 36 in series increases the running duration of the timepiece.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A spring-barrel arrangement for a timepiece, comprising:

a wheel bridge structure having a circular cutout therethrough, said wheel bridge structure having mutually opposing side surfaces, said wheel bridge structure comprising one of a wheel bridge and a plate component arranged parallel to said wheel bridge;

a first spring barrel rotatably mounted in said circular cutout, said spring barrel having a circular outer contour corresponding to said circular cutout and two supporting regions extending radially beyond a diameter of said circular cutout, wherein said supporting regions abut respective ones of the mutually opposing side surfaces of said wheel bridge structure;

a barrel core coaxially rotatably mounted in said spring barrel;

a first helical tension spring having an inner end connected to said barrel core and an outer end connected to said first spring barrel;

a crown wheel having a toothed ring and being fixed to said first spring barrel; and a first wheel of a wheel train of the timepiece being fixed to said barrel core.

2. The spring-barrel arrangement of claim 1, wherein at least one of said supporting regions is releasably connected to said first spring barrel.

3. The spring-barrel arrangement of claim 2, wherein said at least one of said supporting regions is connected to said first spring barrel by a screw connection.

4. The spring-barrel arrangement of claim 1, wherein said first spring barrel is cup-shaped with a base, to which said at least one of said supporting regions is connected.

5. The spring-barrel arrangement of claim 4, wherein said base and at least one of said supporting regions connected to said base define coaxial through-bores, one end of said barrel core projecting out of said first spring barrel through said through-bores.

6. The spring-barrel arrangement of claim 4, wherein said base has a cylindrical centering extension which projects coaxially toward an outside of said first spring barrel, said at least one of said supporting regions being disk-shaped and having a bore corresponding to said centering projection such that said at least one of said supporting regions is positioned on said first spring barrel by said centering region and corresponding bore.

7. The spring-barrel arrangement of claim 4, wherein said base defines a coaxial bearing bore, said first spring barrel arrangement further comprising a bearing in which one end of said barrel core is rotatably mounted.

8. The spring-barrel arrangement of claim 7, said bearing of said barrel core comprising a jewel hole.

9. The spring-barrel arrangement of claim 4, wherein said base defines a coaxial bearing bore in which one end of said barrel core is rotatably mounted.

10. The spring-barrel arrangement of claim 9, said bearing of said barrel core comprising a jewel hole.

11. The spring-barrel arrangement of claim 5, wherein said end of said barrel core projecting out of said first spring barrel bears a gearwheel of an additional device.

12. The first spring-barrel arrangement of claim 5, wherein said end of said barrel core projecting out of said spring barrel bears a gearwheel of a setting mechanism for limiting the number of revolutions of said first spring barrel.

13. The spring-barrel arrangement of claim 5, further comprising a cover with a coaxial opening for closing said through-bore of said second spring barrel, said barrel core projecting through said coaxial opening of said cover.

14. The spring-barrel arrangement of claim 5, wherein said end of said barrel core projecting out of said first spring barrel bears a gearwheel of a mechanism for indicating a power reserve.

15. The spring-barrel arrangement of claim 1, wherein one end of said barrel core is rotatably mounted in a bearing arranged on said wheel bridge structure.

16. The spring-barrel arrangement of claim 15, said bearing of said barrel core comprising a jewel hole.

17. The spring-barrel arrangement of claim 1, further comprising a bottom plate having a bearing, wherein one end of said barrel core is rotatably mounted in said bearing arranged on said fixed bottom plate.

18. The spring-barrel arrangement of claim 17, said bearing of said barrel core comprising a jewel hole.

19. The spring-barrel arrangement of claim 1, wherein said crown wheel comprises one of said supporting regions.

20. The spring-barrel arrangement of claim 19, wherein said crown wheel is a ratchet wheel.

21. The spring-barrel arrangement of claim 1, wherein said first spring barrel includes said toothed ring of said crown wheel.

22. The spring-barrel arrangement of claim 1, wherein at least one of said supporting regions is annular-shaped.

23. The spring-barrel arrangement of claim 1, wherein one of the supporting regions is formed integrally with said first spring barrel.

24. The spring-barrel arrangement of claim 1, wherein said wheel bridge structure has a stepped recess surrounding said circular cutout, one of said supporting regions being axially supported on a base of said stepped recess.

25. The spring-barrel arrangement of claim 24, wherein said base of said stepped recess has an axially projecting annular extension, said one of said supporting regions being supported on said annular extension.

26. The spring-barrel arrangement of claim 1, wherein said a wheel bridge structure consist of said wheel bridge.

27. The spring-barrel arrangement of claim 1, wherein said first wheel of the wheel train is a drive wheel.

28. The spring-barrel arrangement of claim 1, further comprising a second spring barrel arranged coaxially to said first spring barrel, said barrel core projecting through both said first and second spring barrels, said barrel core comprising a barrel stem and a barrel sleeve rotatably mounted on said barrel stem, an inner end of said first tension spring being connected to said barrel sleeve, and a second helical tension spring enclosing said barrel core and having an inner end connected to said barrel sleeve and an outer end connected to said second spring barrel, said first wheel of the wheel train being fixed to said barrel stem and said second spring barrel.

29. The spring-barrel arrangement of claim 28, wherein said second spring barrel is cup-shaped with a base, said barrel stem being fixed to said base.

30. The spring-barrel arrangement of claim 29, further comprising a cover with a coaxial opening for closing said coaxial opening of said second spring barrel, said barrel core projecting through said coaxial opening of said cover.

31. The spring-barrel arrangement of claim 28, wherein said base defines a coaxial opening through which said barrel stem projects.

32. The spring-barrel arrangement of claim 28, wherein said second spring barrel is formed integrally with said first wheel of the wheel train.

33. The spring-barrel arrangement of claim 28, wherein at least one of said first helical tension spring and said second helical tension spring is connected by a self-hooking action by means of a spring rose to one of said barrel core and a respective one of said first and second spring barrels.

34. The spring-barrel arrangement of claim 1, wherein said first helical tension spring is connected by a self-hooking action by means of a spring rose to one of said barrel core and said first spring barrel.

* * * * *